US012246233B2

(12) United States Patent
White et al.

(10) Patent No.: US 12,246,233 B2
(45) Date of Patent: Mar. 11, 2025

(54) ADJUSTABLE BASKETBALL TRAINING DEVICE FOR THE GUIDE HAND

(71) Applicants: Robert M. White, Durham, NC (US); Krista J. Gingrich-White, Durham, NC (US)

(72) Inventors: Robert M. White, Durham, NC (US); Krista J. Gingrich-White, Durham, NC (US)

( * ) Notice: Subject to any disclaimer, the term of this patent is extended or adjusted under 35 U.S.C. 154(b) by 283 days.

(21) Appl. No.: 17/987,212

(22) Filed: Nov. 15, 2022

(65) Prior Publication Data

US 2024/0157213 A1 May 16, 2024

(51) Int. Cl.
*A63B 69/00* (2006.01)

(52) U.S. Cl.
CPC ..... *A63B 69/0059* (2013.01); *A63B 69/0071* (2013.01)

(58) Field of Classification Search
CPC ..... A63B 69/0071; A63B 69/0059
USPC ..... 473/450
See application file for complete search history.

(56) References Cited

U.S. PATENT DOCUMENTS

| | | | |
|---|---|---|---|
| 3,339,926 | A | 9/1967 | Coupar |
| 3,581,312 | A | 6/1971 | Nickels |
| 3,707,730 | A | 1/1973 | Slider |
| 4,377,284 | A | 3/1983 | Okerlin |
| 4,383,685 | A | 5/1983 | Bishop |
| 4,575,089 | A | 3/1986 | Corbett |
| 4,738,447 | A | 4/1988 | Brown |
| 4,919,425 | A | 4/1990 | Wolf |
| 5,135,217 | A | 8/1992 | Swain |
| 5,149,085 | A | 9/1992 | Sanchez |
| 5,188,356 | A | 2/1993 | Furr |
| 5,228,682 | A | 7/1993 | Wolf |
| 5,320,342 | A | 6/1994 | Houck |
| 5,472,206 | A | 2/1995 | Manley |
| 5,651,743 | A | 7/1997 | Stephan |
| 6,095,936 | A | 8/2000 | Kirkpatrick |
| 6,203,453 | B1 | 3/2001 | Coddens |
| 6,283,877 | B1 | 9/2001 | Cook |
| 7,172,522 | B1 | 2/2007 | Harvey |
| 7,399,240 | B2 | 7/2008 | Paukert |
| 7,442,133 | B2 | 10/2008 | Wolf |
| 7,771,293 | B1 | 8/2010 | Vann |
| 7,775,898 | B1 | 8/2010 | Allen |
| 7,789,763 | B1 | 9/2010 | Smith |

(Continued)

*Primary Examiner* — Mitra Aryanpour

(57) ABSTRACT

This is an adjustable basketball training device for a user's guide hand comprising upper arm, pivot, forearm, thumb, and finger components. The pivot component is pivotably connected to the upper arm component and rigidly coupled to the forearm component. The forearm component is rigidly coupled to both the thumb component using separate telescopic complexes, which allows the user to adjust the device for proper fit. The upper arm, forearm, thumb, and finger components are each secured to the user's upper arm, forearm, thumb, and at least one finger, respectively. As such, the basketball training device not only restricts flexion and opposition of the thumb but it restricts pronation of the user's forearm. In addition, the basketball training device restricts flexion, extension, radial deviation, and ulnar deviation of the user's wrist while allowing the user appropriate extension at the elbow joint during the entire shooting motion.

8 Claims, 9 Drawing Sheets

(56) References Cited

U.S. PATENT DOCUMENTS

| | | | | |
|---|---|---|---|---|
| 8,052,546 | B1 | 11/2011 | Nagel | |
| 8,152,660 | B1 * | 4/2012 | Jimenez, Jr. ..... | A63B 69/0071 473/422 |
| 8,425,339 | B2 | 4/2013 | Basden | |
| 9,545,556 | B2 | 1/2017 | Mohammed | |
| 9,731,181 | B2 * | 8/2017 | Klunick ..... | A63B 69/0071 |
| 9,757,637 | B1 * | 9/2017 | Glaser ..... | A63B 69/0071 |
| 10,561,917 | B1 | 2/2020 | Naro | |
| 10,596,435 | B2 | 3/2020 | White | |
| 11,389,709 | B2 | 7/2022 | Spartz | |
| 2007/0270248 | A1 | 11/2007 | Ffrench | |
| 2011/0230283 | A1 | 9/2011 | Hougen | |
| 2017/0319935 | A1 | 11/2017 | Griffee | |
| 2022/0105406 | A1 | 4/2022 | Piazza | |
| 2024/0157213 | A1 * | 5/2024 | White ..... | A63B 69/0059 |

* cited by examiner

ADJUSTABLE BASKETBALL TRAINING DEVICE FOR THE GUIDE HAND

CROSS REFERENCE TO RELATED APPLICATION

Not applicable.

STATEMENT REGARDING FEDERALLY SPONSORED RESEARCH DEVELOPMENT

Not applicable.

REFERENCE TO SEQUENCE LISTING, A TABLE, OR A COMPUTER PROGRAM LISTING COMPACT DISK APPENDIX

Not Applicable.

BACKGROUND OF INVENTION

1. Field of Invention

The present invention relates to the field of basketball training aids. More specifically, this invention is in the field of basketball shooting aids, which are used for proper positioning and movement of the user's guide hand.

2. Description of Related Art

To become an accurate basketball shooter, an athlete must exercise proper shot mechanics, which are reinforced by consistent repetition. Proper mechanics for shooting a basketball involve, in large part, an athlete's stance and proper alignment of the shooting hand and basketball with respect to the basketball rim. Because a basketball is shot with only one hand, which is typically an athlete's dominant hand, a lot of emphasis is placed on proper vertical alignment of the shooting shoulder, shooting elbow, and shooting hand with respect to the basketball rim.

While significant attention to this alignment is important, the mechanics of the off-hand or guide hand are equally important. Too often, though, an athlete focuses significant attention on the mechanics of the shooting hand while neglecting those of the guide hand. As a result, an athlete may tend to shoot with both hands, which can resemble more of a pushing of the basketball towards the rim. Alternatively, an athlete may generally shoot with only his or her shooting hand, but the thumb of the guide hand will come through towards the basket with the release of the basketball, affecting its trajectory and spin, leading to inconsistent and inaccurate shooting.

A variety of basketball shooting aids have been developed over the years, a majority of these training aids being directed almost exclusively to the mechanics of the shooting hand. U.S. Pat. No. 4,383,685 describes one such training aid. This training aid comprises an arcuate guide secured to a vest worn by the athlete and an elbow sleeve linked to the guide. Being linked to the arcuate guide, the elbow sleeve restricts movement of the athlete's shooting elbow along a prescribed plane that is in alignment with the basketball rim. However, this aid does nothing to ensure proper mechanics of the athlete's guide hand. U.S. Pat. No. 3,707,730 (a glove for the shooting hand that encourages proper hand spacing on the basketball) and U.S. Pat. No. 5,135,217 (a finger harness for the shooting hand that is attached via a strap to an upper arm cuff) are other examples of basketball training aids geared exclusively toward the shooting hand.

A number of patents disclose basketball training aids that couple the movements of the shooting hand and the guide hand. For example, U.S. Pat. No. 8,052,546 discloses a pair of bracelets worn around the wrists of both the user's shooting hand and guide hand. A coupler links the two bracelets together, continuous linkage between the two bracelets during the shooting motion supposedly ensuring proper shooting form. However, as suggested above, the mechanics of the shooting hand and the guide hand are necessarily different and cannot be coupled together in this manner. The shooting hand, in conjunction with the shooting shoulder and shooting elbow, is the only hand that actually shoots the basketball. The shooting shoulder, shooting elbow, and shooting hand move dynamically along a plane that is in perfect vertical alignment with the center of the basket. The guide hand, however, is relatively static throughout the entire shooting motion and serves a limited role of keeping the basketball secure in the shooting hand. As such, the movement of the guide hand must not effect the movement of shooting hand and, thus, necessarily cannot be coupled to the movement of the shooting hand. Other examples of basketball training aids that couple the movements of the shooting hand and the guide hand include U.S. Pat. No. 11,389,709 (sleeves on shooting arm and opposite arm are coupled by a loop bridge), U.S. Pat. No. 7,399,240 (a single band encircles both the wrist of the shooting hand and the wrist of the guide hand) and U.S. Pat. No. 4,377,284 (cuffs around both the forearm of the shooting hand and the forearm of the guide hand are strapped together).

A variety of ineffective training aids have been developed that focus attention on the mechanics of only the guide hand during the shooting motion. The aid described in U.S. Pat. No. 4,919,425 comprises a thumb loop attached to a strap. The strap is wrapped over the top of the wrist and around the forearm, where it is then secured to a pair of sleeves positioned on either side of the elbow of the guide hand. When the strap is tightened, movement of the guide hand's thumb relative to the guide hand's elbow is limited. However, while thumb abduction, flexion or opposition may be limited, these movements are not restricted sufficiently to prevent negative effects on the overall shooting motion. In fact, this aid does nothing to prevent pronation of the forearm which, assuming thumb abduction, flexion and opposition are limited, still allows pronation of the wrist joint and subsequent movement of the thumb relative to this joint. In addition, this aid does nothing to prevent flexion, extension, radial deviation, or ulnar deviation of the wrist joint, movements which can negatively affect the overall shooting motion. Lastly, by not sufficiently restricting movement of more than just the thumb of the guide hand, this aid does very little to promote the passive role the guide hand has in the overall shooting motion. U.S. Pat. No. 5,228,682 (eliminates one of the elbow sleeves in the aid just described) and U.S. Pat. No. 7,442,133 (adds a middle finger sleeve that does nothing to limit flexion of this finger and, thus, does not promote the passive role of the guide hand in the overall shooting motion) are separate embodiments developed by the same inventor.

The training aid disclosed in U.S. Pat. No. 5,320,342 comprises a chest strap coupled to a shoulder strap, the shoulder strap being linked to a relatively rigid control rod having a thumb loop. With the thumb of the guide hand inserted through the thumb loop, movement of the thumb is restricted because it is effectively anchored to the chest and shoulder of the user. This ineffective aid has a number of crucial flaws, however. First, the guide hand's thumb is anchored inward relative to the guide hand's shoulder, promoting pronation of the guide hand's forearm. This is the type of movement that must be prevented with respect to the guide hand. In addition, the elbow of the guide hand is unnecessarily restricted so that it cannot extend adequately during the overall shooting motion. Some measure of elbow extension must be allowed to satisfy the role of the guide hand during the overall shooting motion. A similar aid is described in U.S. Pat. No. 6,203,453, although a loop for the index finger is added.

Another example of a training aid geared toward the mechanics of the guide hand is described in U.S. Pat. No. 6,283,877. This aid comprises a belt worn around the user's waist and a band worn around the wrist of the user's guide hand. The band and belt are connected by an assembly of lines or cords, such that the connection restricts forward movement of the guide hand. However, this aid does not prevent abduction, flexion, opposition of the guide hand's thumb, nor pronation of the guide hand's forearm. Further, it does not allow for adequate extension of the guide hand's elbow during the overall shooting motion. In fact, this aid does little to promote proper mechanics of the guide hand and prevent the negative effects improper mechanics have on the overall shooting motion.

In U.S. Pat. No. 5,188,356, a training aid used for the guide hand is described comprising only a wrist strap having a finger loop extension connected to it. In one embodiment, the wrist strap encircles the wrist of the guide hand and the finger loop encircles the thumb of the guide hand. Tension between the wrist strap and the finger loop are presumed to restrict flexion or opposition of the thumb relative to the wrist. Assuming this aid is effective in that regard, it does nothing to prevent pronation of the guide hand's forearm, which results in movement of the thumb relative to the elbow. This aid also does nothing to restrict flexion, extension, radial deviation, or ulnar deviation of the wrist. In an alternate embodiment, the finger strap runs over the top of the thumb and around to loop around the index finger of the guide hand. Still, pronation of the forearm and extraneous movements of the wrist are not restricted, providing little aid to ensuring proper mechanics of the guide hand.

Because the guide hand serves a limited role, which is primarily to keep the basketball secure in the shooting hand, the proper mechanics of the guide hand help to ensure a fairly static and relatively passive motion. In particular, proper mechanics help to ensure that neither pronation of the guide hand's forearm nor flexion or opposition of the guide hand's thumb occur during the shooting motion. Other movements that should be restricted include flexion, extension, radial deviation and ulnar deviation of the wrist. Ultimately, the palmar surface of the guide hand, which is initially placed on the side of the basketball, must remain parallel to the sagittal plane of the user during the shooting motion. However, extension of the elbow must be allowed, if only in a limited range. By restricting these movements, the guide hand is less likely to negatively effect the trajectory and spin of the basketball or the vertical alignment of the shooting hand, shooting elbow, and shooting shoulder with respect to the center of the basket.

In light of prior art, there remains a need for a single, adjustable basketball training aid that can accomplish these goals and reinforce the proper mechanics of the guide hand during the entire shooting motion. Such a training aid must promote an overall static and passive motion of the guide hand by restricting extraneous movement of the guide hand wherever possible while still allowing for comfortable and effective use during a variety of basketball shooting drills. In addition, this training aid should be adjustable in a relatively broad range to accommodate different body types.

BRIEF SUMMARY OF INVENTION

According to one embodiment, an adjustable basketball training device used to promote proper mechanics of the guide hand comprises an upper arm component, a pivot component, a forearm component, a finger component, and a thumb component.

The thumb component and forearm component are coupled by way of a telescopic complex comprising a plurality of rigid elongated coupling members, a thumb-side sliding component, and a forearm-side sliding component. A rigid elongated coupling member passes through and is slidably engaged with the thumb-side sliding component. One end of the rigid elongated coupling member is secured to the thumb component and an opposite end is secured to the forearm-side sliding component. Another rigid elongated coupling member passes through and is slidably engaged with the forearm-side sliding component.

One end of this rigid elongated coupling member is secured to the forearm component and an opposite end is secured to the thumb-side sliding component. As such, the thumb component can telescope nearer to or farther from the forearm component within a range defined, in part, by the lengths of the rigid elongated coupling members.

The finger component and forearm component are coupled by way of a second telescopic complex comprising a second plurality of rigid elongated coupling members, a finger-side sliding component, and a second forearm-side sliding component. A rigid elongated coupling member passes through and is slidably engaged with the finger-side sliding component. One end of the rigid elongated coupling member is secured to the finger component and an opposite end is secured to the second forearm-side sliding component. Another rigid elongated coupling member passes through and is slidably engaged with the second forearm-side sliding component. One end of this rigid elongated coupling member is secured to the forearm component and an opposite end is secured to the finger-side sliding component. As such, the finger component can telescope nearer to or farther from the forearm component within a range defined, in part, by the lengths of the rigid elongated coupling members.

The pivot component is pivotably connected to the upper arm component. The forearm component and the pivot component are coupled by at least one rigid elongated coupling member, whereby one end of a rigid elongated coupling member is secured at one end to the forearm component and at an opposite end to the pivot component. As such, the forearm component is pivotably connected to the upper arm component by way of a direct coupling with the pivot component.

Each component is secured to the user's arm or hand by way of adjustable straps so that the upper arm component is secured to the lateral side of the user's bicep, the forearm component is secured to the dorsal side of the user's forearm, the finger component is secured to the dorsal side of at least one of the user's fingers, and the thumb component is secured to the dorsal side of the user's thumb. While adjustable straps are preferred to allow a fit comfortable for any user, other means for securing these components to corresponding positions on the user's arm and hand can be used, such as elastic bands.

According to another embodiment, the telescopic complexes described above also comprise a locking mechanism. The locking mechanism, when engaged, locks the relative position of each component in the telescopic complex. By locking the relative position of these components, a user can resume training with minimal readjustment between training sessions. A further embodiment discloses an upper arm component comprising a flexion and extension stop, which limits the operable range of the associated pivot component.

Once the adjustable basketball training device has been secured to the user's guide hand, forearm and upper arm, the user is prepared to train in the proper mechanics of the guide hand during the entire shooting motion. The adjustable basketball training device not only restricts flexion and opposition of the thumb but also restricts pronation of the user's forearm. In addition, the adjustable basketball training device restricts flexion, extension, radial deviation, and ulnar deviation of the user's wrist while allowing the user appropriate extension at the elbow joint during the entire shooting motion.

Figure 1:
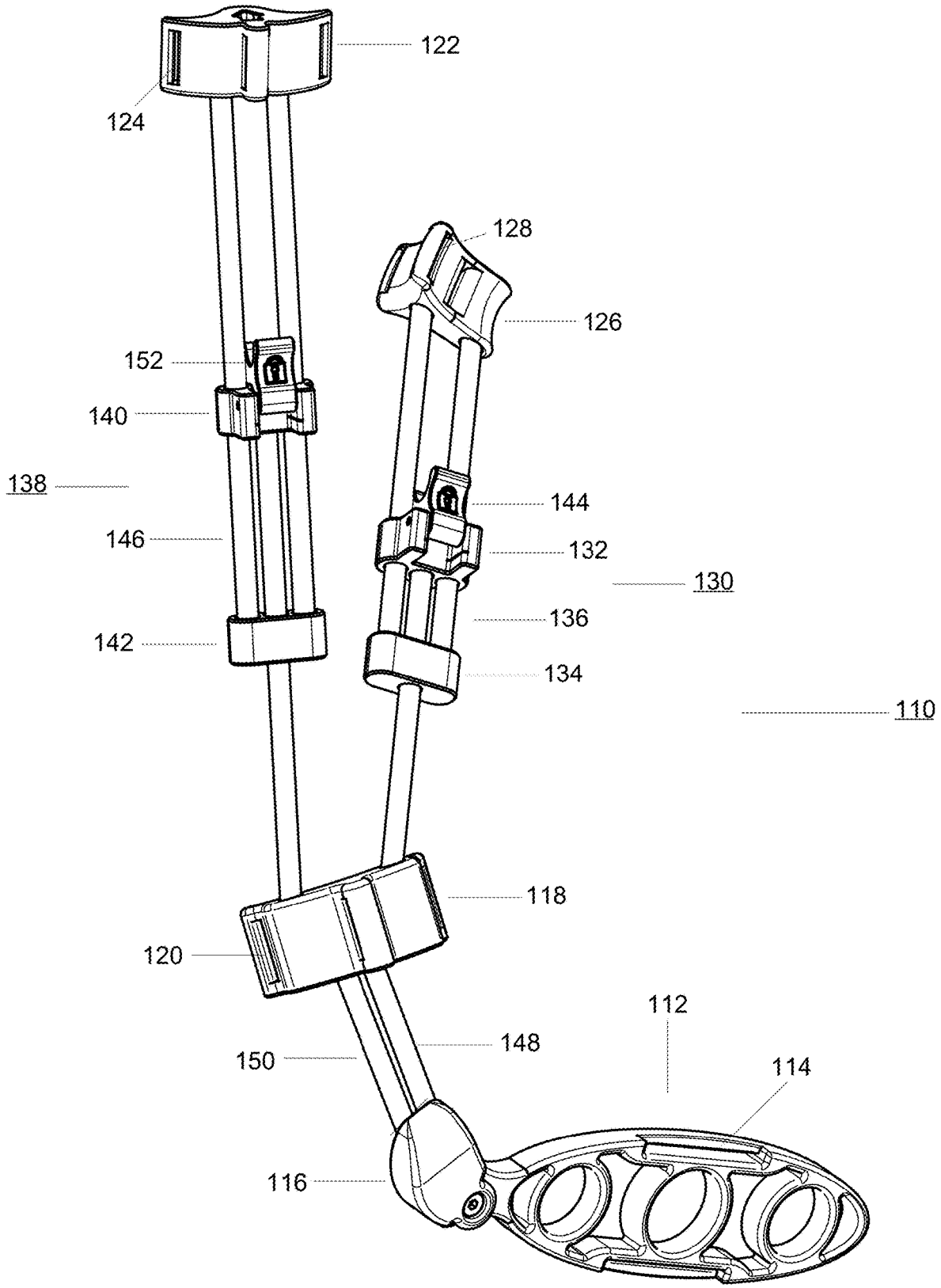
FIG. 1 is a perspective view of one embodiment of a basketball training device.

REFERENCE NUMERALS FOR DRAWINGS (Please note that the first digit indicates the figure in which a component is first readily identifiable):

| | |
|---|---|
| 110 | Basketball training device |
| 112 | Upper arm component |
| 114 | Upper arm strap through-slot |
| 116 | Pivot component |
| 118 | Forearm component |
| 120 | Forearm strap through-slot |
| 122 | Finger component |
| 124 | Finger strap through-slot |
| 126 | Thumb component |
| 128 | Thumb strap through-slot |
| 130 | First telescopic complex |
| 132 | Thumb-side sliding component |
| 134 | First forearm-side sliding component |
| 136 | First plurality of elongated coupling members |
| 138 | Second telescopic complex |
| 140 | Finger-side sliding component |
| 142 | Second forearm-side sliding component |
| 144 | First locking mechanism |

-continued

REFERENCE NUMERALS FOR DRAWINGS (Please note that the first digit indicates the figure in which a component is first readily identifiable):

| | |
|---|---|
| 146 | Second plurality of elongated coupling members |
| 148 | First forearm-pivot coupling member |
| 150 | Second forearm-pivot coupling member |
| 152 | Second locking mechanism |
| 218 | First proximal forearm component attachment point |
| 220 | Second proximal forearm component attachment point |
| 222 | First finger component attachment point |
| 224 | Second finger component attachment point |
| 226 | First thumb component attachment point |
| 228 | Second thumb component attachment point |
| 316 | First pivot component attachment point |
| 318 | Second pivot component attachment point |
| 320 | First distal forearm component attachment point |
| 322 | Second distal forearm component attachment point |
| 454 | Pivot screw |
| 456 | Pivot nut |
| 458 | Pivot barrel |
| 460 | Pivot component mounting hole |
| 462 | Elbow flexion-extension limiter |
| 554 | First pivot pin |
| 556 | First pivot pin mounting hole |
| 558 | First elongated coupling member |
| 560 | Second elongated coupling member |
| 562 | Third elongated coupling member |
| 564 | Proximal thumb-side attachment point |
| 566 | First thumb-side bore |
| 568 | Second thumb-side bore |
| 570 | First forearm-side bore |
| 672 | First distal forearm-side attachment point |
| 674 | Second distal forearm-side attachment point |
| 754 | Second pivot pin |
| 756 | Second pivot pin mounting hole |
| 758 | Fourth elongated coupling member |
| 760 | Fifth elongated coupling member |
| 762 | Sixth elongated coupling member |
| 764 | Proximal finger-side attachment point |
| 766 | First finger-side bore |
| 768 | Second finger-side bore |
| 770 | Second forearm-side bore |
| 872 | Third distal forearm-side attachment point |
| 874 | Fourth distal forearm-side attachment point |
| 910 | Basketball training device |
| 915 | Upper arm strap |
| 921 | Forearm strap |
| 925 | Finger strap |
| 929 | Thumb strap |
| 976 | User |

DETAILED DESCRIPTION OF DRAWINGS

FIG. 1 is a perspective view of one embodiment of a basketball training device 110 that comprises an upper arm component 112, a pivot component 116, a forearm component 118, a finger component 122, a thumb component 126, a first telescopic complex 130, a second telescopic complex 138, a first forearm-pivot coupling member 148 and a second forearm-pivot coupling member 150. The upper arm component 112 comprises at least one upper arm strap through-slot 114. An upper arm strap is fed through the upper arm through-slot 114, which allows the user to secure the upper arm component 112 to his or her upper arm. The pivot component 116 is pivotably connected to the upper arm component 112 using a pivot screw 454 and a corresponding pivot nut 456. The pivot screw 454 can be a fully-threaded screw, partially-threaded screw, shoulder screw, bolt, pin, or other suitable fastener. The pivot screw 454 and pivot nut 456 are visualized better in FIG. 4.

Figure 2:
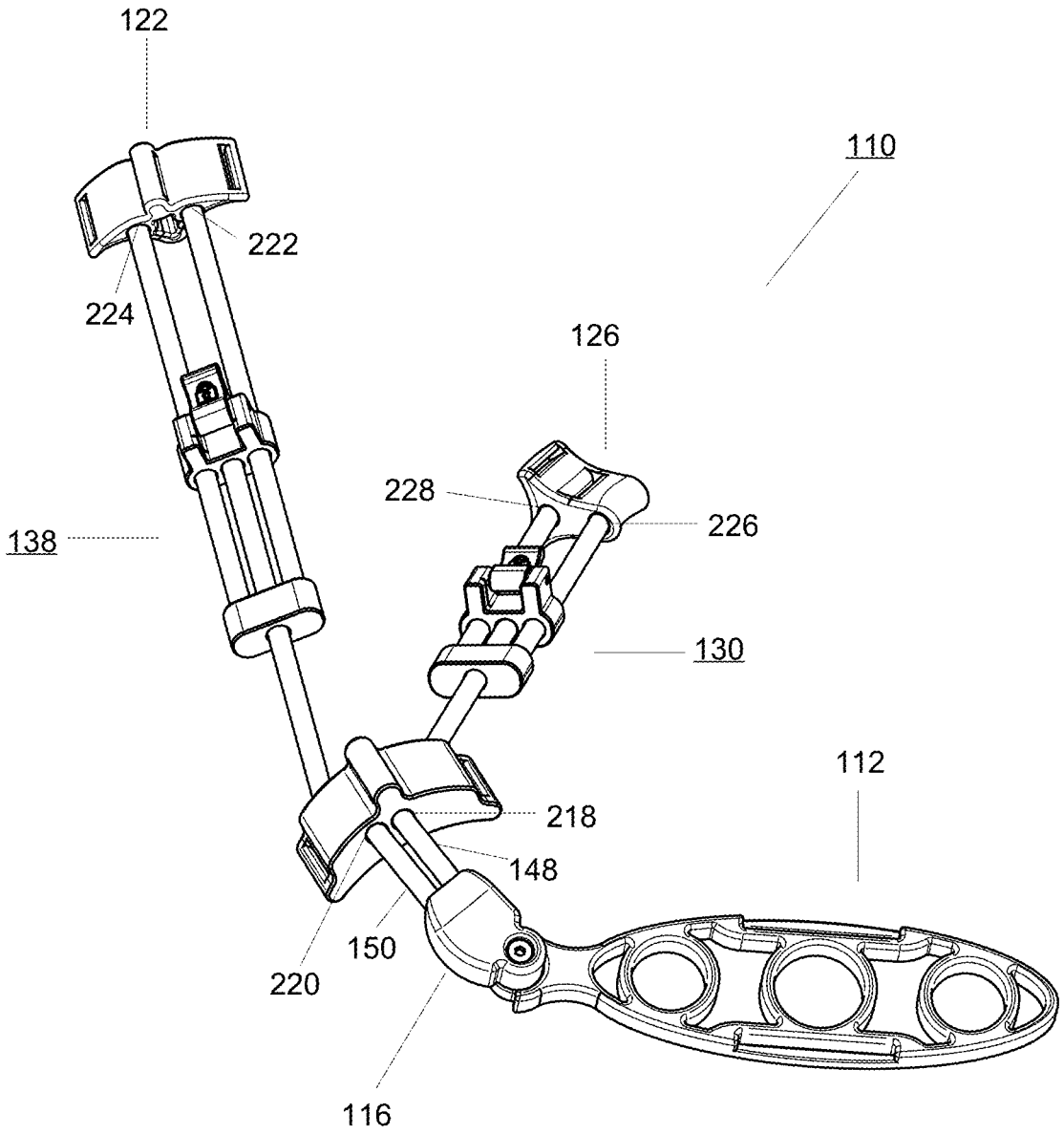
FIG. 2 is another perspective view of the embodiment depicted in FIG. 1.

The forearm component 118 comprises at least one forearm strap through-slot 120, a first proximal forearm attachment point 218, and a second proximal forearm component attachment point 220 (SEE FIG. 2). A forearm strap is fed through the forearm through-slot 114, which allows the user to secure the forearm component 118 to his or her forearm. The thumb component 126 comprises at least one thumb strap through-slot 128, a first thumb component attachment point 226, and a second thumb component attachment point 228. A thumb strap is fed through the thumb strap through-slot 128, which allows the user to secure the thumb component 126 to his or her thumb. The finger component 122 comprises at least one finger strap through-slot 124 and a first finger component attachment point 222 and a second finger component attachment point 224. A finger strap is fed through the finger strap through-slot 124, which allows the user to secure the finger component 122 to at least one of his or her fingers.

The first telescopic complex 130 comprises a first plurality of elongated coupling members 136, a thumb-side sliding component 132, a first forearm-side sliding component 134, and a first locking mechanism 144. The second telescopic complex 138 comprises a second plurality of elongated coupling members 146, a finger-side sliding component 140, a second forearm-side sliding component 142, and a second locking mechanism 152. The first locking mechanism 144 and second locking mechanism 152, which lock the relative positions of associated elongated coupling members, are discussed in more detail below (See FIG. 5 and FIG. 7).

According to this embodiment of a basketball training device 110, the first plurality of elongated coupling members 136 comprises a first elongated coupling member 558, a second elongated coupling member 560, and a third elongated coupling member 562. The thumb-side sliding component 132 comprises a first thumb-side bore 566, a second thumb-side bore 568, and a proximal thumb-side attachment point 564. The first forearm-side sliding component 134 comprises a first forearm-side bore 570, a first distal forearm-side attachment point 672, and a second distal forearm-side attachment point 674 (See FIG. 5 and FIG. 6).

The first elongated coupling member 558 passes through the first thumb-side bore 566 and is slidably engaged with the thumb-side sliding component 132. Similarly, the second elongated coupling member 560 passes through the second thumb-side bore 568 and is slidably engaged with the thumb-side sliding component 132. A proximal end of the first elongated coupling member 558 is attached to the first distal forearm-side attachment point 672 and a distal end of the first elongated coupling member 558 is attached to a first thumb component attachment point 226. Similarly, a proximal end of the second elongated coupling member 560 is attached to the second distal forearm-side attachment point and a distal end of the second elongated coupling member 560 is attached to a second thumb component attachment point 228. The third elongated coupling member 562 passes through the first forearm-side bore 570 and is slidably engaged with the first forearm-side sliding component 134. A distal end of the third elongated coupling member 562 is attached to the proximal thumb-side attachment point 564 and a proximal end of the third elongated coupling member 562 is attached to a first distal forearm component attachment point 320.

As such, both the thumb-side sliding component 132 and first forearm-side sliding component 134 can slide along an axis parallel to the central axes of the first plurality of elongated coupling members 136. When the thumb-side sliding component 132 and first forearm-side sliding component 134 are slidably positioned closer to one another, the distance between the thumb component 126 and the forearm component 118 approaches a maximum. In contrast, when the thumb-side sliding component 132 and the first forearm-side sliding component 134 are slidably positioned farther apart, the distance between the thumb component 126 and the forearm component 118 approaches a minimum. The maximum and minimum distances are defined, in part, by the lengths of the first plurality of elongated coupling members 136.

Regarding the second telescopic complex 138, the second plurality of elongated coupling members 146 comprises a fourth elongated coupling member 758, a fifth elongated coupling member 760, and a sixth elongated coupling member 762. The finger-side sliding component 140 comprises a first finger-side bore 766, a second finger-side bore 768, and a proximal finger-side attachment point 764. The second forearm-side sliding component 142 comprises a second forearm-side bore 770, a third distal forearm-side attachment point 872, and a fourth distal forearm-side attachment point 874 (See FIG. 7 and FIG. 8).

The fourth elongated coupling member 758 passes through the first finger-side bore 766 and is slidably engaged with the finger-side sliding component 140. Similarly, the fifth elongated coupling member 760 passes through the second finger-side bore and is slidably engaged with the finger-side sliding component 140. A proximal end of the fourth elongated coupling member 758 is attached to the third distal forearm-side attachment point 872 and a distal end of the fourth elongated coupling member 758 is attached to a first finger component attachment point 222. Similarly, a proximal end of the fifth elongated coupling member 760 is attached to the fourth distal forearm-side attachment point 874 and a distal end of the fifth elongated coupling member 760 is attached to a second finger component attachment point 224. The sixth elongated coupling member 762 passes through the second forearm-side bore 770 and is slidably engaged with the second forearm-side sliding component 142. A distal end of the sixth elongated coupling member 762 is attached to the proximal finger-side attachment point 764 and a proximal end of the sixth elongated coupling member 762 is attached to a second distal forearm component attachment point 322.

As such, both the finger-side sliding component 140 and second forearm-side sliding component 142 can slide along an axis parallel to the central axes of the second plurality of elongated coupling members 146. When the finger-side sliding component 140 and second forearm-side sliding component 142 are slidably positioned closer to one another, the distance between the finger component 122 and the forearm component 118 approaches a maximum. In contrast, when the finger-side sliding component 140 and the second forearm-side sliding component 142 are slidably positioned farther apart, the distance between the finger component 122 and the forearm component 118 approaches a minimum. The maximum and minimum distances are defined, in part, by the lengths of the second plurality of elongated coupling members 146.

The pivot component 116 further comprises a first pivot component attachment point 316 and a second pivot component attachment point 318. According to the present embodiment, a distal end of a first forearm-pivot coupling member 148 is attached to a first proximal forearm component attachment point 218 and a proximal end of a the first forearm-pivot coupling member 148 is attached to a first pivot component attachment point 316 (See FIG. 2 and FIG. 3). Similarly, a distal end of a second forearm-pivot coupling member 150 is attached to a second proximal forearm component attachment point 220 and a proximal end of the second forearm-pivot coupling member 150 is attached to a second pivot component attachment point 318. As such, the forearm component 118 is directly coupled to the pivot component 116, which is pivotably connected to the upper arm component 112.

Each of the elongated coupling members are formed from a rigid material such as fiber-reinforced plastic (i.e. Fiberglass), carbon fiber, aluminum, or other sufficiently rigid material. The attachment points described herein are preferably sockets adapted for the insertion of an elongated coupling member. The elongated coupling member is secured in the socket using, preferably, an adhesive. However, other means, such as a set screw or other mechanical means, may be used to ensure that the elongated coupling member is secured within the socket.

Regarding the telescopic complexes described above, it is well understood to one skilled in the art that the telescopic means can be accomplished in other ways. For example, a telescopic complex can comprise a smaller diameter tube inserted into and slidably engaged with a larger diameter tube. This telescopic complex can incorporate a locking collar or other means for securing their relative positions, such as used with telescoping broom handles or poles used by painters.

FIG. 2 is another perspective view of the embodiment illustrated in FIG. 1. The basketball training device 110 comprises an upper arm component 112, a pivot component 116, a forearm component 118, a thumb component 126, a finger component 122, a first telescopic complex 130, a second telescopic complex 138, a first forearm-pivot coupling member 148, and a second forearm-pivot coupling member 150.

As discussed in the description of FIG. 1, the forearm component 118 comprises a first proximal forearm component attachment point 218 and a second proximal forearm component attachment point 220, the finger component 122 comprises a first finger component attachment point 222 and a second finger component attachment point 224, and the thumb component 126 comprises a first thumb component attachment point 226 and a second thumb component attachment point 228.

Figure 3:
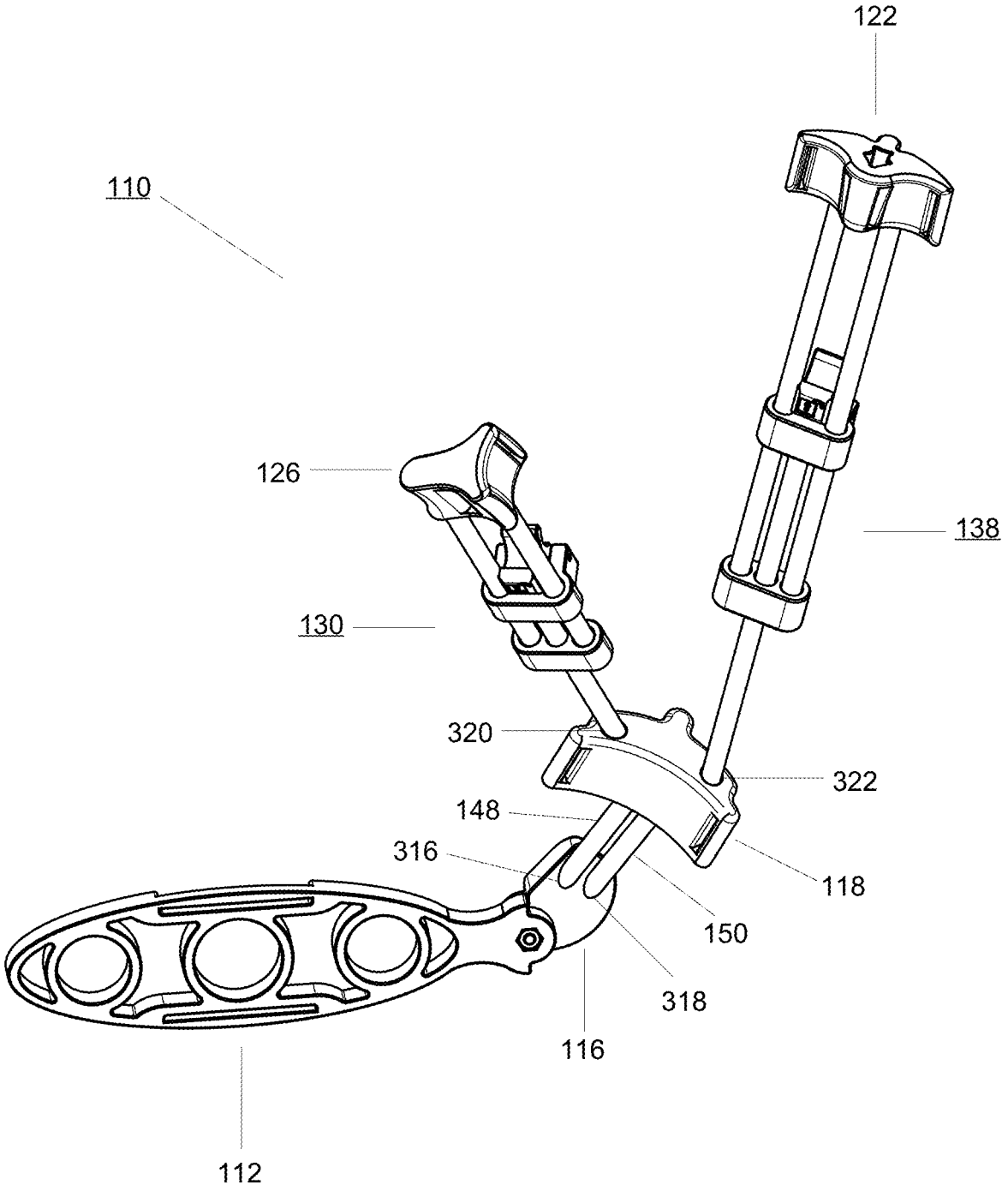
FIG. 3. is another perspective view from an opposing angle of the embodiment depicted in FIG. 2.

FIG. 3 is another perspective view from an opposing angle of the embodiment illustrated in FIG. 2. The basketball training device 110 comprises an upper arm component 112, a pivot component 116, a forearm component 118, a thumb component 126, a finger component 122, a first telescopic complex 130, a second telescopic complex 138, a first forearm-pivot coupling member 148, and a second forearm-pivot coupling member 150.

As discussed in the description of FIG. 1, the forearm component 118 comprises a first distal forearm component attachment point 320 and second distal forearm component attachment point 322. The pivot component 116 comprises a first pivot component attachment point 316 and a second pivot component attachment point 318.

Figure 4:
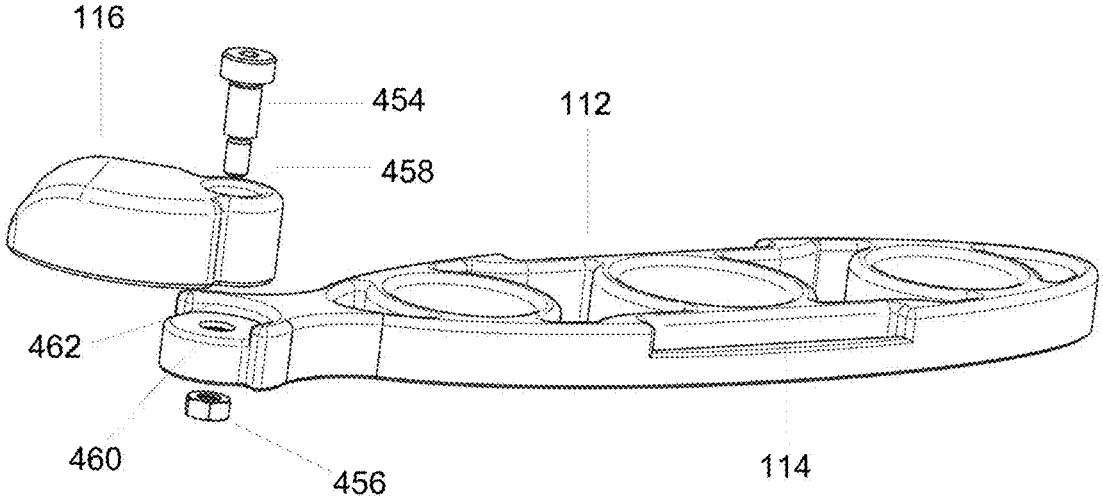
FIG. 4 is an exploded perspective view of one embodiment of an upper arm component and associated pivot component.

FIG. 4 is an exploded perspective view of one embodiment of an upper arm component 112 and associated pivot component 116. The upper arm component 112 comprises at least one upper arm strap through-slot 114, an elbow flexion-extension limiter 462, and a pivot component mounting hole 460. The pivot component 116 comprises a pivot barrel 458. The pivot component 116 is pivotably connected to the upper arm component 112 using a pivot screw 454 and a pivot nut 456. The elbow flexion-extension limiter 462 restricts the degree of elbow flexion and elbow extension allowed by the basketball training device 110.

Figure 5:
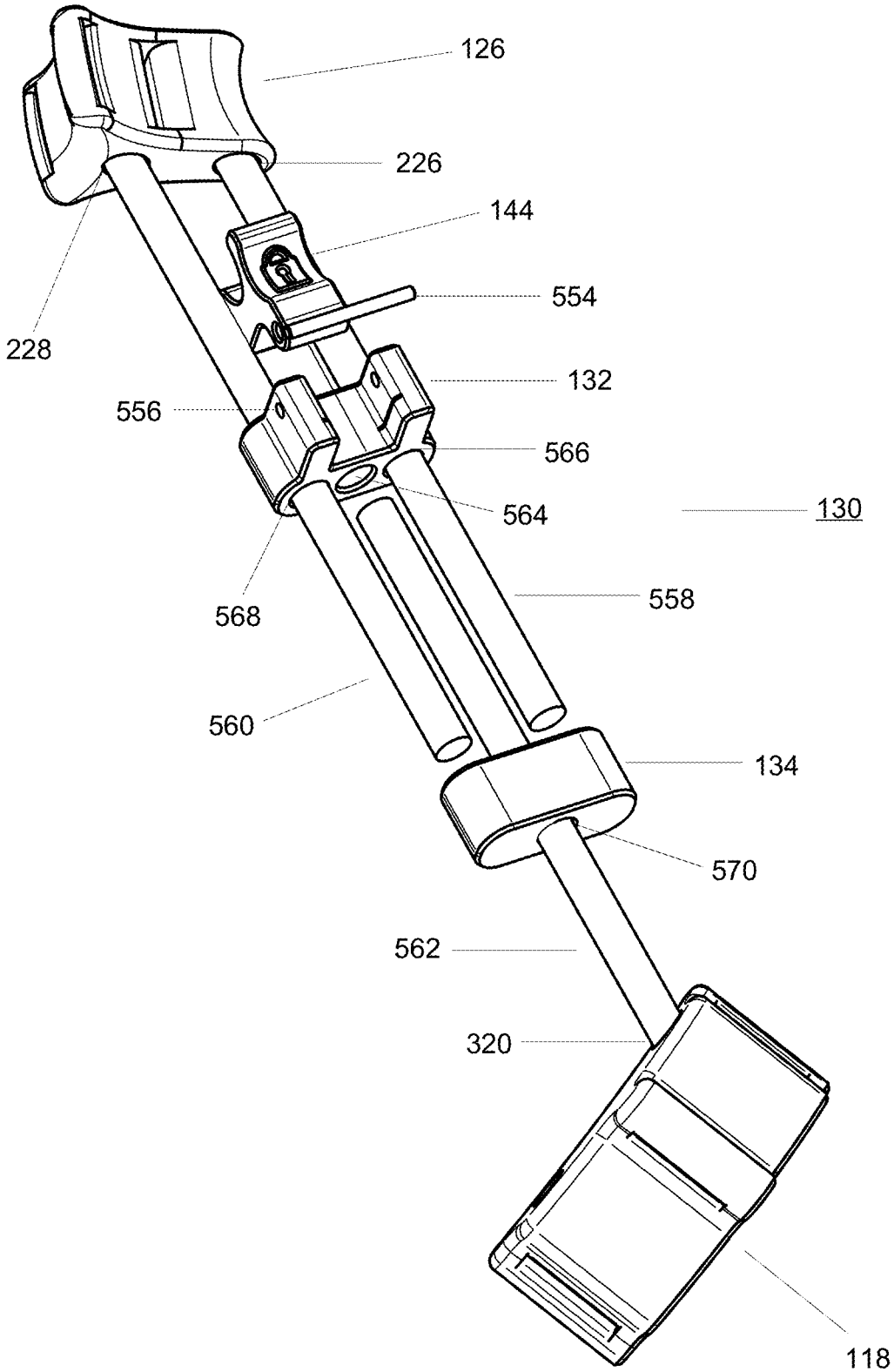
FIG. 5 is an exploded perspective view of one embodiment of a first telescopic complex.

FIG. 5 is an exploded perspective view of one embodiment of a first telescopic complex 130 with an associated thumb component 126 and a forearm component 118. The first telescopic complex 130 comprises a first plurality of elongated coupling members 136, a thumb-side sliding component 132, a first forearm-side sliding component 134, and a first locking mechanism 144.

The first plurality of elongated coupling members 136 comprises a first elongated coupling member 558, a second elongated coupling member 560, and a third elongated coupling member 562. The thumb-side sliding component 132 comprises a first thumb-side bore 566, a second thumb-side bore 568, and a proximal thumb-side attachment point 564. The first forearm-side sliding component 134 comprises a first forearm-side bore 570, a first distal forearm-side attachment point 672, and a second distal forearm-side attachment point 674. The first distal forearm-side attachment point 672 and second distal forearm-side attachment point 674 are visualized better in FIG. 6.

The first elongated coupling member 558 passes through the first thumb-side bore 566 and is slidably engaged with the thumb-side sliding component 132. Similarly, the second elongated coupling member 560 passes through the second thumb-side bore 568 and is slidably engaged with the thumb-side sliding component 132. A proximal end of the first elongated coupling member 558 is attached to the first distal forearm-side attachment point 672 (See FIG. 6) and a distal end of the first elongated coupling member 558 is attached to a first thumb component attachment point 226. Similarly, a proximal end of the second elongated coupling member 560 is attached to the second distal forearm-side attachment point 674 (See FIG. 6) and a distal end of the second elongated coupling member 560 is attached to a second thumb component attachment point 228. The third elongated coupling member 562 passes through the first forearm-side bore 570 and is slidably engaged with the first forearm-side sliding component 134. A distal end of the third elongated coupling member 562 is attached to the proximal thumb-side attachment point 564 and a proximal end of the third elongated coupling member 562 is attached to a first distal forearm component attachment point 320.

A first pivot pin 554 pivotably connects the first locking mechanism 144 to a first pivot pin mounting hole 556 incorporated into the thumb-side sliding component 140. The first locking mechanism 144 can then rotate around an axis defined by the first pivot pin 554. In the locked position, the first locking mechanism 144 is pressed down and between the first elongated coupling member 558 and the second elongated coupling member 560 to form an interference fit (i.e. Press fit or friction fit). To unlock, the first locking mechanism 144 is pulled from between these elongated coupling members and rotated to an unlocked position.

As such, both the thumb-side sliding component 132 and first forearm-side sliding component 134 can slide along an axis parallel to the central axes of the first plurality of elongated coupling members 136. When the thumb-side sliding component 132 and first forearm-side sliding component 134 are slidably positioned closer to one another, the distance between the thumb component 126 and the forearm component 118 approaches a maximum. In contrast, when the thumb-side sliding component 132 and the first forearm-side sliding component 134 are slidably positioned farther apart, the distance between the thumb component 126 and the forearm component 118 approaches a minimum. The maximum and minimum distances are defined, in part, by the lengths of the first plurality of elongated coupling members 136.

Figure 6:
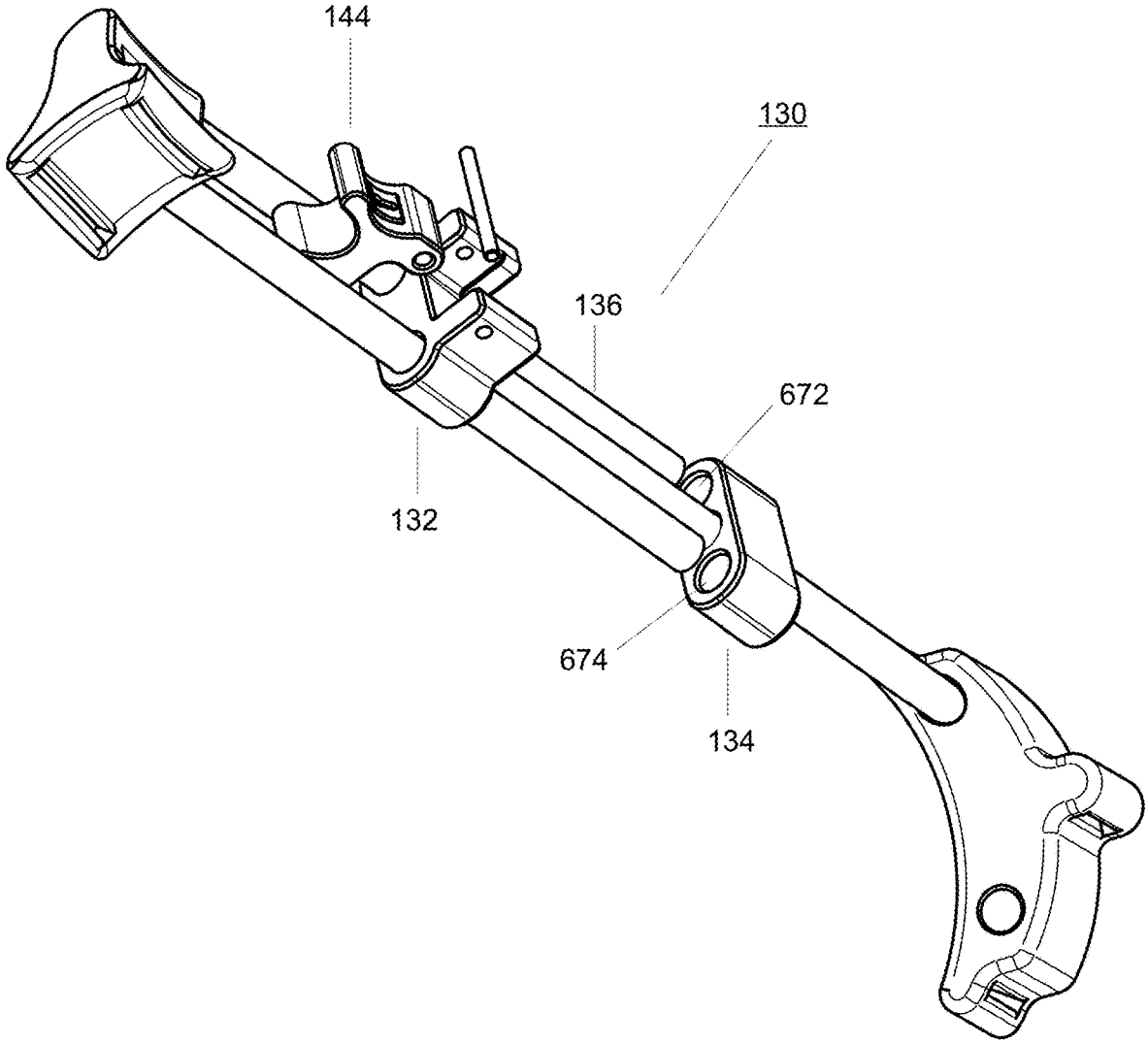
FIG. 6 is an exploded perspective view from a different angle of the first telescopic complex embodiment depicted in FIG. 5.

FIG. 6 is an exploded perspective view from a different angle of the first telescopic complex 130 embodiment depicted in FIG. 5, which better illustrates the first distal forearm-side attachment point 672 and second distal forearm-side attachment point 674.

Figure 7:
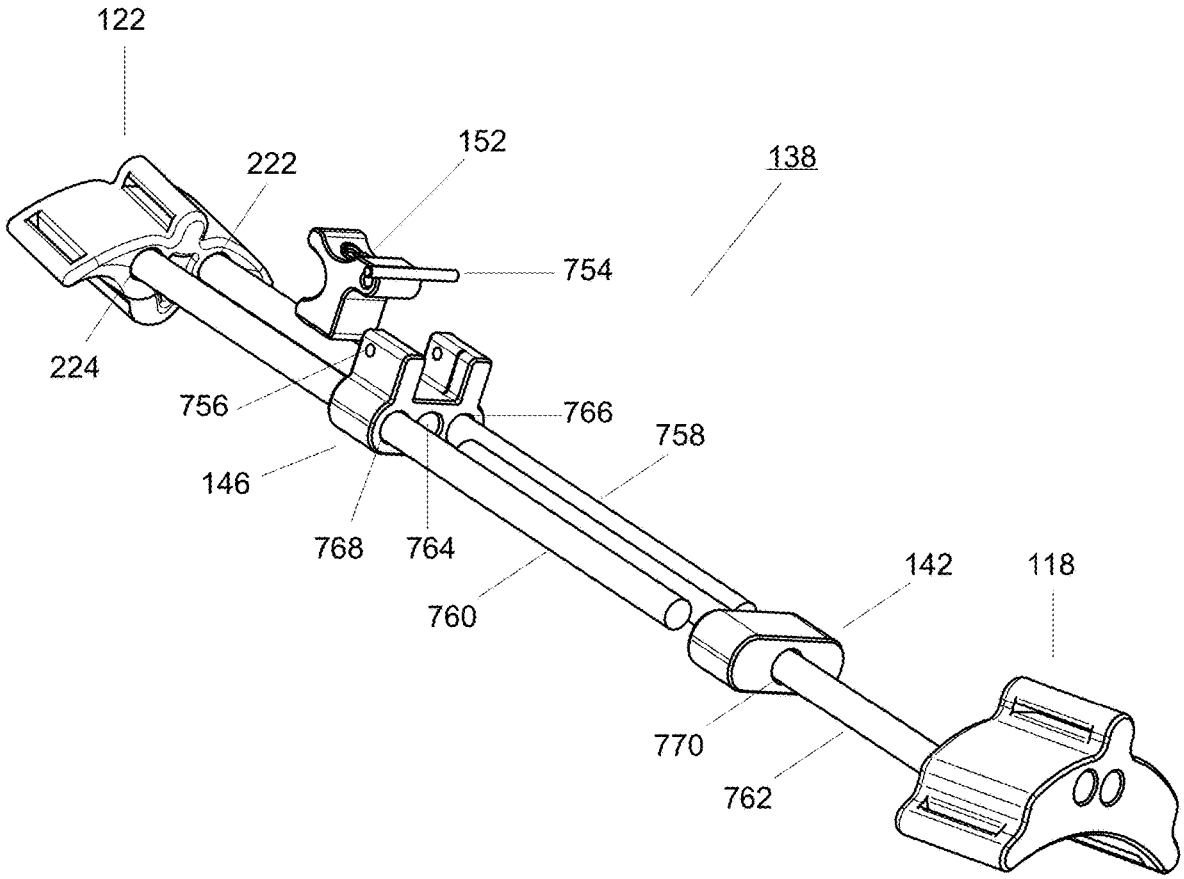
FIG. 7 is a perspective view of one embodiment of the basketball training device positioned on a user's arm and hand.

FIG. 7 is an exploded perspective view of one embodiment of a second telescopic complex 138 with an associated finger component 122 and a forearm component 118. The first telescopic complex 138 comprises a second plurality of elongated coupling members 146, a finger-side sliding component 140, a second forearm-side sliding component 142, and a second locking mechanism 152.

The second plurality of elongated coupling members 146 comprises a fourth elongated coupling member 758, a fifth elongated coupling member 760, and a sixth elongated coupling member 762. The finger-side sliding component 140 comprises a first finger-side bore 766, a second finger-side bore 768, and a proximal finger-side attachment point 764. The second forearm-side sliding component 142 comprises a second forearm-side bore 770, a third distal forearm-side attachment point 872, and a fourth distal forearm-side attachment point 874. The third distal forearm-side attachment point 872 and fourth distal forearm-side attachment point 874 are visualized better in FIG. 8.

The fourth elongated coupling member 758 passes through the first finger-side bore 766 and is slidably engaged with the finger-side sliding component 140. Similarly, the fifth elongated coupling member 760 passes through the second finger-side bore 768 and is slidably engaged with the finger-side sliding component 140. A proximal end of the fourth elongated coupling member 758 is attached to the third distal forearm-side attachment point 872 (See FIG. 8) and a distal end of the fourth elongated coupling member 758 is attached to a first finger component attachment point 222. Similarly, a proximal end of the fifth elongated coupling member 760 is attached to the fourth distal forearm-side attachment point 874 and a distal end of the fifth elongated coupling member 760 is attached to a second finger component attachment point 224. The sixth elongated coupling member 762 passes through the second forearm-side bore 770 and is slidably engaged with the second forearm-side sliding component 142. A distal end of the sixth elongated coupling member 762 is attached to the proximal finger-side attachment point 764 and a proximal end of the sixth elongated coupling member 762 is attached to a second distal forearm component attachment point 322.

A second pivot pin 754 pivotably connects the second locking mechanism 152 to a second pivot pin mounting hole 756 incorporated into the finger-side sliding component 140. The second locking mechanism 152 can then rotate around an axis defined by the second pivot pin 754. In the locked position, the second locking mechanism 152 is pressed down and between the fourth elongated coupling member 758 and the fifth elongated coupling member 760 to form an interference fit. To unlock, the second locking mechanism 152 is pulled from between these elongated coupling members and rotated to an unlocked position.

As such, both the finger-side sliding component 140 and second forearm-side sliding component 142 can slide along an axis parallel to the central axes of the second plurality of elongated coupling members 146. When the finger-side sliding component 140 and second forearm-side sliding component 146 are slidably positioned closer to one another, the distance between the finger component 122 and the forearm component 118 approaches a maximum. In contrast, when the finger-side sliding component 140 and the second forearm-side sliding component 142 are slidably positioned farther apart, the distance between the finger component 122 and the forearm component 118 approaches a minimum. The maximum and minimum distances are defined, in part, by the lengths of the second plurality of elongated coupling members 146.

Figure 8:
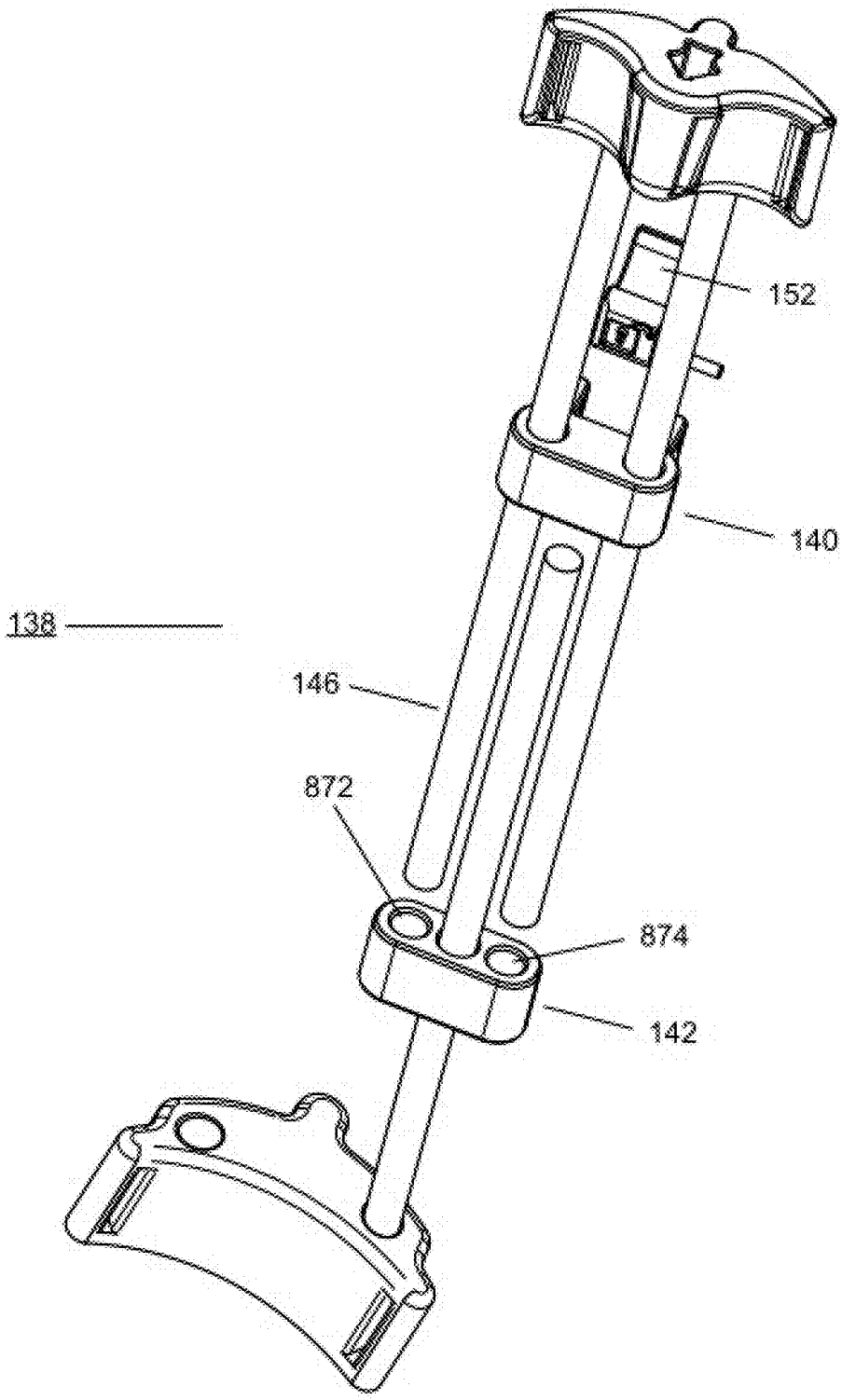
FIG. 8 is an exploded perspective view from a different angle of the second telescopic complex.

FIG. 8 is an exploded perspective view from a different angle of the second telescopic complex 138 embodiment depicted in FIG. 7, which better illustrates the third distal forearm-side attachment point 872 and fourth distal forearm-side attachment point 874.

Figure 9:
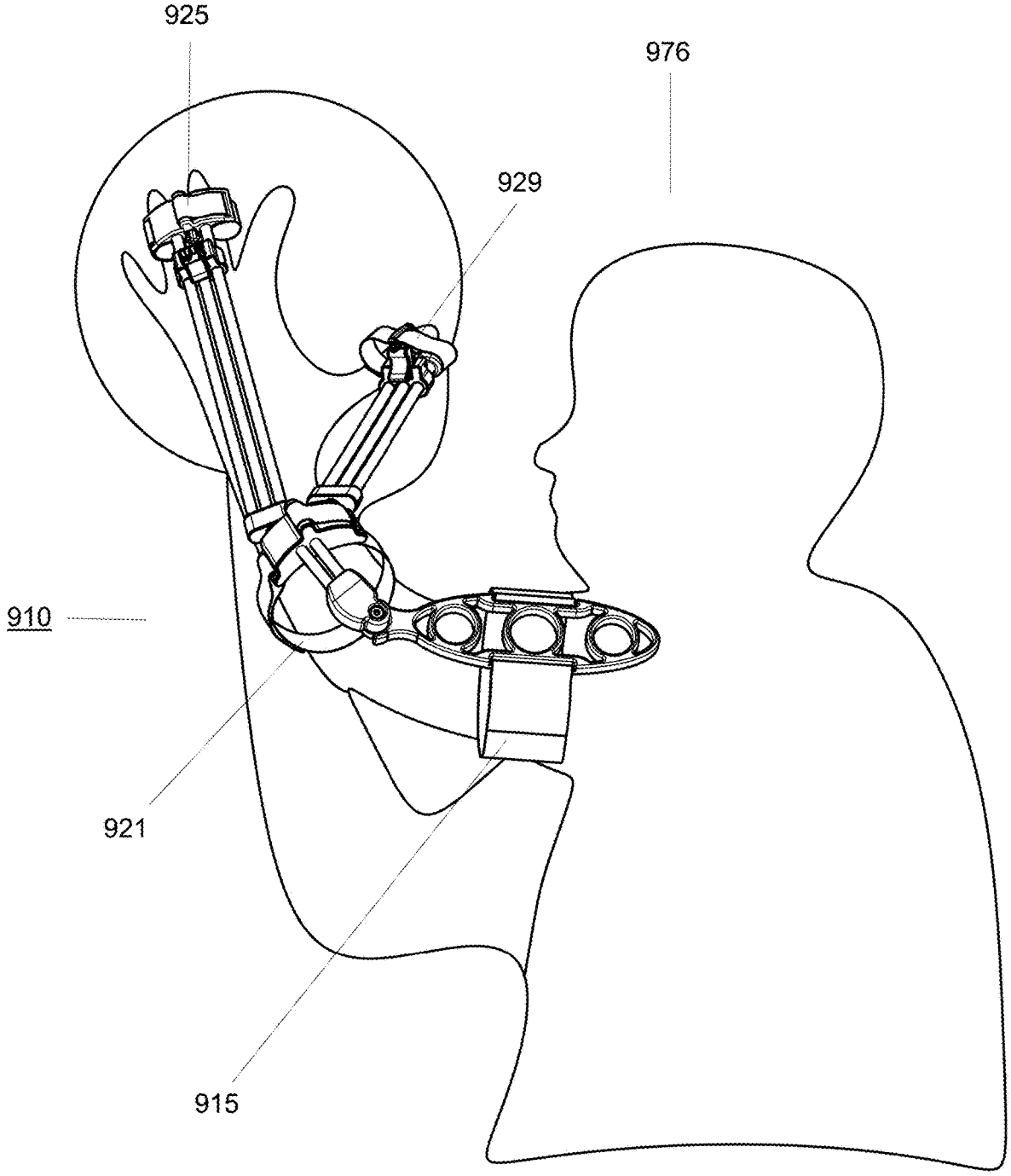
FIG. 9 is a perspective view of one embodiment of a basketball training device positioned on a user's arm and hand, which also illustrates the upper arm strap, forearm strap, thumb strap, and finger strap.

FIG. 9 is a perspective view of one embodiment of a basketball training device 910 positioned on a user's 976 arm and hand. An upper arm strap 915, a forearm strap 921, a finger strap 925, and a thumb strap 929 secure the basketball training device 910 on the user's 976 arm and hand.

While specific embodiments and applications of the present invention have been described herein, it will be apparent to those of ordinary skill in the art that many variations on the embodiments and applications described are possible without departing from the scope of the invention. It should be understood that while certain embodiments of the invention have been shown and described, the invention is not to be limited to the specific embodiments described and illustrated.

The invention claimed is:

1. An adjustable basketball training device for a user's guide hand, comprising:

an upper arm component comprising at least one upper arm strap through-slot and pivot mounting socket;

an upper arm strap attached to said at least one upper arm strap through-slot, said upper arm component configured to be secured to a user's upper arm with said upper arm strap;

a pivot component comprising at least one pivot attachment point and a gudgeon, said gudgeon pivotably connected to said pivot mounting socket;

a forearm component comprising at least one forearm strap through-slot, at least one proximal forearm attachment point, and a first distal forearm attachment point;

a forearm strap attached to said at least one forearm strap through-slot, said forearm component configured to be secured to a user's forearm with said forearm strap;

a thumb component comprising at least one thumb strap through-slot and a thumb attachment point, a thumb strap attached to said at least one thumb strap through-slot, said thumb component configured to be secured to a user's thumb with said thumb strap;

a first telescopic complex comprising a first distal end and a first proximal end, said first distal end attached to said thumb attachment point and said first proximal end attached to said first distal forearm attachment point; and at least one forearm-pivot coupling member comprising a first end and a second end, said first end attached to said at least one pivot attachment point and said second end attached to said at least one proximal forearm attachment point;

whereby said upper arm component is configured to be secured to said user's upper arm, said pivot component is pivotably connected to said upper arm component, said pivot component is coupled to said forearm component by way of said at least one forearm-pivot coupling member, said forearm component is configured to be secured to said user's forearm, said forearm component is coupled to said thumb component by way of said first telescopic complex, and said thumb component is configured to be secured to said user's thumb.

2. The adjustable basketball training device of claim 1 further comprising:

an elbow flexion-extension limiter;

whereby said elbow flexion-extension limiter limits a user's elbow flexion and a user's elbow extension.

3. The adjustable basketball training device of claim 2 further comprising:

a first telescopic complex locking mechanism;

whereby said first telescopic complex locking mechanism locks a relative positions of said thumb component and said forearm component.

4. The adjustable basketball training device of claim 1 further comprising:

a first telescopic complex locking mechanism;

whereby said first telescopic complex locking mechanism locks a relative positions of said thumb component and said forearm component.

5. The adjustable basketball training device of claim 1 further comprising:

a finger component comprising at least one finger strap through-slot and a finger attachment point;

a finger strap attached to said at least one finger strap through-slot, said finger component configured to be secured to at least one of user's fingers with said finger strap;

said forearm component further comprising a second distal forearm attachment point; and a second telescopic complex comprising a second distal end and a second proximal end, said second distal end attached to said finger attachment point and said second proximal end attached to said second distal forearm attachment point;

whereby said upper arm component is configured to be secured to said user's upper arm, said pivot component is pivotably connected to said upper arm component, said pivot component is coupled to said forearm component by way of said at least one forearm-pivot coupling member, said forearm component is configured to be secured to said user's forearm, said forearm component is coupled to said thumb component by way of said first telescopic complex, said thumb component is configured to be secured to said user's thumb, said finger component is coupled to said forearm component by way of said second telescopic complex, and said finger component is configured to be secured to said at least one of said user's fingers.

6. The adjustable basketball training device of claim 5 further comprising:

an elbow flexion-extension limiter;

whereby said elbow flexion-extension limiter limits a user's elbow flexion and a user's elbow extension.

7. The adjustable basketball training device of claim 6 further comprising:

a first telescopic complex locking mechanism; and a second telescopic complex locking mechanism;

whereby said first telescopic complex locking mechanism locks the relative positions of said thumb component and said forearm component and said second telescopic complex locking mechanism locks the relative positions of said finger component and said forearm component.

8. The adjustable basketball training device of claim 5 further comprising:

a first telescopic complex locking mechanism; and a second telescopic complex locking mechanism;

whereby said first telescopic complex locking mechanism locks the relative positions of said thumb component and said forearm component and said second telescopic complex locking mechanism locks the relative positions of said finger component and said forearm component.

* * * * *